United States Patent [19]

Campbell

[11] Patent Number: 4,621,811

[45] Date of Patent: Nov. 11, 1986

[54] BASKETBALL TRAINING DEVICE

[76] Inventor: John F. Campbell, 6030 Fairway La., Wescosville, Pa. 18106

[21] Appl. No.: 844,678

[22] Filed: Mar. 27, 1986

[51] Int. Cl.[4] ..... A63B 69/00

[52] U.S. Cl. ..... 273/1.5 A

[58] Field of Search ..... 273/1.5 A

[56] References Cited

U.S. PATENT DOCUMENTS

| | | | |
|---|---|---|---|
| 2,570,860 | 10/1951 | Redding | 273/1.5 A UX |
| 2,697,603 | 12/1954 | Haines | 273/1.5 A |
| 2,939,705 | 6/1960 | McCall, Jr. | 273/1.5 A |
| 3,012,781 | 12/1961 | Nelson | 273/1.5 A |
| 3,023,001 | 2/1962 | Gourdouze | 273/1.5 A |
| 3,288,466 | 11/1966 | Cumings | 273/1.5 A |
| 3,717,342 | 2/1973 | Haney et al. | 273/1.5 A |
| 4,161,313 | 7/1979 | Dickey | 273/1.5 A |
| 4,244,569 | 1/1981 | Wong | 273/1.5 A |
| 4,296,925 | 10/1981 | Alston | 273/1.5 A |
| 4,506,886 | 3/1985 | Lamb, Sr. | 273/1.5 A |

*Primary Examiner*—Paul E. Shapiro

*Attorney, Agent, or Firm*—Ruth Moyerman

[57] ABSTRACT

A training device for developing skills in the game of basketball utilizing a hoop rim mounted on an elevated backboard above a playing surface is disclosed. An angular rope support arm is attached at its proximal end by a bracket to a hoop rim so that the support arm's distal end terminates above and proximate a hoop. A rope of a predetermined length is slidably connected to the support arm with one end of the rope long enough to project downward from the proximal end of the support arm so that it may be grasped by a user. The other rope end projects downward from the distal end of the support arm and receives a basketball. Suspension of the ball proximate the hoop may be controlled by the user to permit players to increase their skills in jumping to grasp or move the ball.

15 Claims, 4 Drawing Figures

BASKETBALL TRAINING DEVICE

BACKGROUND OF THE INVENTION

1. Field of the Invention

This invention relates to a physical education training device and more particularly to a basketball training device.

2. Description of the Prior Art

Because of the increasingly high quality of basketball being played today, the need for coaches to employ more effective training methods has never been more evident. This is particularly true in the rebounding phase as basketball becomes more and more the tall man's game; for example, the game played above the rim.

No training device, however, is known that emphasizes development of all skills essential to strong rebounding; for example, jumping skills, ball awareness and improved timing.

SUMMARY OF THE DISCLOSURE

The aforementioned prior art problems are obviated by the device of this invention in which a training device for developing skills in a ball game utilizing a hoop rim mounted on an elevated backboard above a playing surface is provided.

The device is comprised of an angular rope support arm with means to attach the support arm's proximal end to a hoop rim so that the support arm's distal end terminates above and proximate the hoop. A rope of a predetermined length is slidably connected to the support arm with one end long enough to project downward from the proximal end of the rope support arm so that a user may grasp the end while standing proximate the playing surface. The other rope end projects downward from the distal end of the rope support arm and receives a ball. The ball's suspension proximate the hoop may be controlled by the user to permit players to increase their skills by jumping to grasp or move the ball.

An alternate embodiment includes a positioning pole for simplified attachment of the device to the hoop rim. Also, the height of the ball can be varied and measured by a scale on the positioning pole and held in place by a clamp.

It is, therefore, a primary object of this invention to provide a training device for use in ball and hoop games, primarily basketball.

It is also an object of this invention to provide a device that provides trouble-free positioning that fits all standard type rims.

It is a further object of this invention to provide a device that can be used by a single player or in team drills, attended or unattended coaching stations.

It is likewise an object of this invention to provide a device that allows for non-interference on at least one side of the rim.

It is yet another object of this invention to provide a device that allows the ball to be stationary or set in motion, and allows tapping drills for taller, more skilled, players.

It is still another object of this invention to provide a device that provides exact height measurements of a ball from the playing surface.

These and other objects will be more readily ascertainable to one skilled in the art from a consideration of the following Figures, description and exemplary embodiments.

BRIEF DESCRIPTION OF THE DRAWING(S)

FIG. 3 is a fragmentary side view of the preferred embodiment of the device of this invention showing one of the spring actuated clamps attached to the hoop rim bracket.

DETAILED DESCRIPTION OF THE PREFERRED EMBODIMENT(S)

Figures 1, 2:
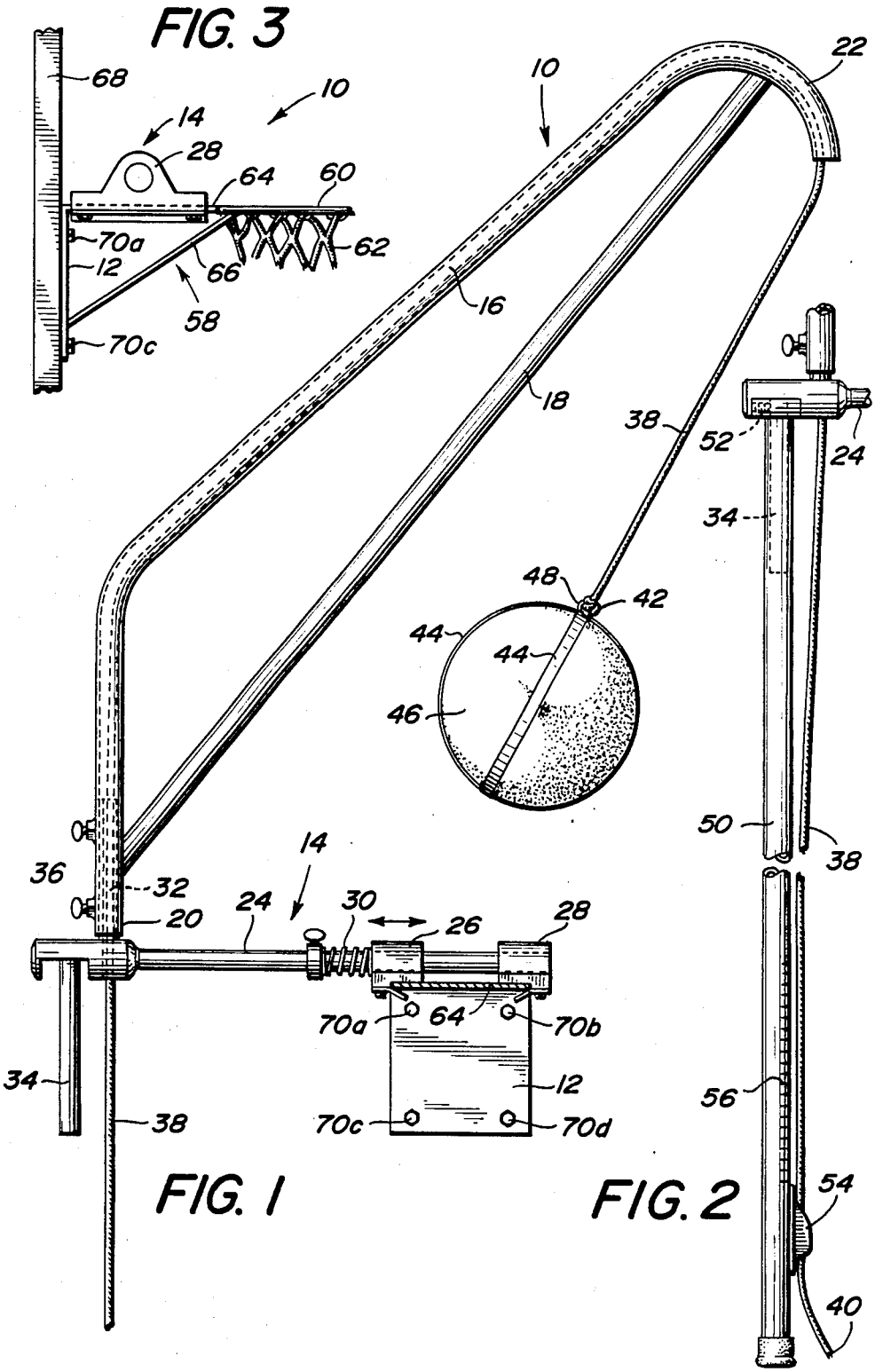
FIG. 1 is a front view of the preferred embodiment of the device of this invention showing the device mounted on the back plate of the hoop rim bracket with the backboard omitted.
FIG. 2 is a fragmentary cutaway front view of the device of this invention showing the positioning pole attached to the mounting bracket.

Referring now to the drawings, and more particularly to FIGURE 1, device 10 is shown mounted by screw locations 70(a), (b), (c) and (d) on back plate 12 through removable bracket 14. Angular channeled support arm 16 includes lower brace 18 spanning from proximate proximal end 20 to proximate distal end 22. Removable bracket 14 includes arm 24, terminating at its one end in clamps 26 and 28, adjustable by spring 30. Clamps 26 and 28 affix movable bracket 14 to back plate 12 of a hoop rim bracket. Removable bracket 14 terminates at its other end in opposing legs 32 (in phantom) and 34 at right angle to arm 24. Leg 32 is sized to interfit support arm 16's proximal end 20 and is secured thereto in this embodiment by winged nuts 36.

Rope 38, which is preferably an elastic bungie cord, is seen slidably threaded through channeled support arm 16 and channeled leg 32. Rope 38 contains sufficient length to project downward from proximal end 20 of support arm 16 to allow a user to grasp it while standing proximate a playing surface. Other rope end 42 is of sufficient length to project downward from distal end 22 of support arm 16 proximate and above hoop back plate 12. Webb belt 44 surrounds ball 46 and is attached to rope end 42 by D ring 48, thereby suspending ball 46 proximate and above hoop back plate 12.

Ball 46's suspension from rope 38 proximate back plate 12 (hoop rim and net shown in FIG. 4) may be controlled by a user to permit players to increase their skills by jumping to grasp or move ball 46.

Referring now to FIG. 2, a fragmentary cutaway shows positioning pole 50 releasable attached to other leg 34 of arm 24 by way of spring actuated fitting 52. End 40 of rope 38 has been secured to pole 50 through clamp 54. Positioning pole 50 aids in mounting arm 24 to a hoop rim bracket (not shown) from a remote location. Pole 50 is of a predetermined length to be operable by a user standing on the floor near the hoop.

Measuring device 56 measures the height of a ball from the playing surface.

Referring now to FIG. 3, a fragmentary side view of device 10 more clearly shows how clamp 28 of arm 24 (not shown in this view) is attached to hoop rim mounting bracket 58. Hoop rim mounting bracket 58 includes rim 60 for retaining net 62. Rim 60 is connected to back plate 12 by arm 64. Diagonal support 66 acts as a brace for hoop rim mounting bracket 58. Back plate 12 is mounted to back board 68 by screws at locations 70 (a), (b), (c) and (d). Clamp 28 of arm 24 (not shown) has been secured to arm 64, thereby securing the mounting means or removable bracket 14 (only clamp 28 is shown) to hoop rim mounting bracket 58.

Figure 4:
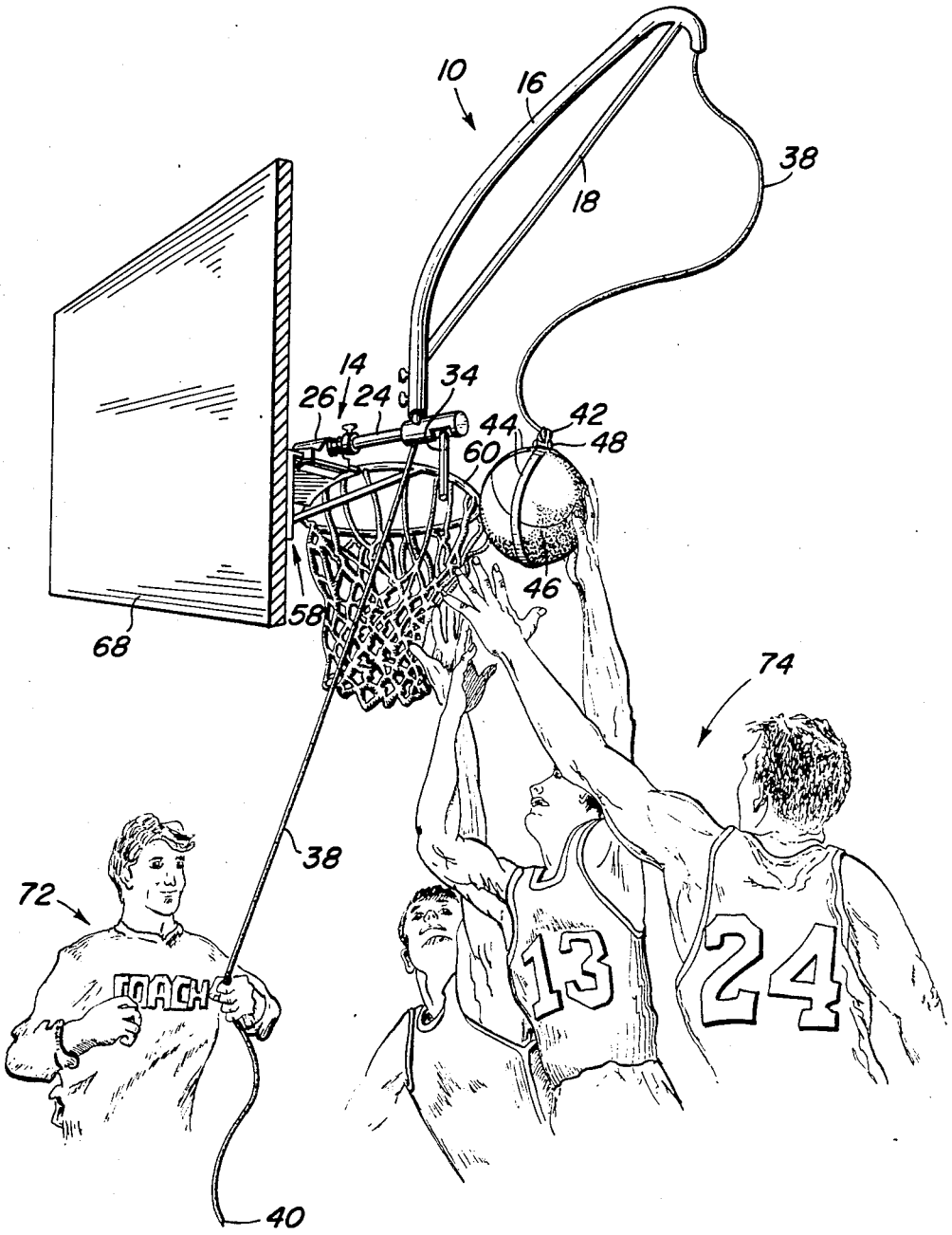
FIG. 4 is a schematic view of the device of this invention showing the ball's height being regulated by a user coach.

Referring now to FIG. 4, a schematic view of device 10 is shown. Angular support arm 16 with lower brace 18 has been attached to hoop rim mounting bracket 58, including arm 24, by way of clamps 26 and 28 (only clamp 26 is shown) of removable bracket 14. Bracket 58 has been secured to backboard 68. Leg 34 is shown free of positioning pole 50.

Rope 38 has been slidably threaded through support arm 16 so that ball 46 is suspended from its other end 42 proximate rim 60. User 72 has grasped rope 38 approximate end 40 in order to control the height of ball 46. Player 74 may therefore increase their skills by jumping to grasp and move ball 46.

There are many variations which may be practiced within the scope of this invention. While a channeled angular support arm is illustrated, any manner which slidably suspends a ball proximate and above the rim would be acceptable and still be within the scope of this invention.

Furthermore, while a removable mounting bracket is illustrated, the bracket need not be removable as it is merely a preference. Any means to attach the support arm to the hoop rim or backboard area is acceptable so long as it fulfills the intended purpose.

The positioning pole with its clamp and measuring device is not critical to this invention, but merely a preferable way to attach this device to the area of the rim.

While a bungie cord is a preferred rope because of its elasticity, any rope or cord is satisfactory.

While construction of the device of aluminum is preferred because of its light weight, any material is satisfactory.

The device of this invention has many advantages. Chiefly among these is that it forces players, through proper supervision, not only to increase their jumping skills, but also to improve coordination, timing and rebounding techniques as well.

Second, the device provides for trouble-free positioning on all standard type rims.

Third, the device can be used by a single player or in team drills, attended or unattended coaching stations.

Fourth, the device allows for non-interference on at least one side of the rim.

Also, the device allows the ball to be stationary or set into deliberate motion, and allows tapping drills for taller, more skilled players.

Finally, the device is portable and requires little storage room.

Having now illustrated and described my invention, it is not my intention that such description limit the invention, but that the invention be limited only by a reasonable interpretation of the appended claims.

What is claimed is:

1. A training device for development skills in the game of basketball or the like sport utilizing a hoop rim mounted on an elevated backboard above a playing surface, said device comprising:

(a) an angular rope support arm;

(b) means to attach said support arm's proximal end to a hoop rim so that the support arm's distal end terminates above and proximate said hoop;

(c) rope of a predetermined length adapted to be slidably connected to said support arm so that one end of said rope contains sufficient length to project downward from said proximal end of said mounted support arm to allow a user to grasp said end while standing proximate a playing surface, the other rope end being of sufficient length to project downward from said distal end of said mounted support arm proximate and above said mounted hoop; and, (d) means to attach said rope's said other end to a ball, so that a ball's suspension from the rope proximate said hoop may be controlled by said user to permit players to increase their skills by jumping to grasp or move said ball.

2. The device according to claim 1 wherein said angular support arm is a channeled body adapted to receive therethrough said rope.

3. The device according to claim 1 wherein said angular support arm also includes a lower brace spanning from proximate said proximal end to proximate said distal end.

4. The device according to claim 1 wherein said means to attach said support arm's proximal end to a hoop rim is a removable bracket.

5. The device according to claim 4 wherein said bracket includes an arm terminating at one end in a rim mounting means.

6. The device according to claim 5 wherein said rim mounting means are adjustable spring actuated clamps.

7. The device according to claim 5 wherein said bracket arm terminates at its other end in a pair of opposing legs at right angles to said bracket arm, said one leg being channeled to receive said rope and sized to interfit with said support arms proximal end.

8. The device according to claim 7 wherein said proximal end of said support arm includes a locking means adapted to mate with said one leg of said bracket arm.

9. The device according to claim 8 wherein said locking means includes a plurality of winged nuts.

10. The device according to claim 4 wherein said device includes, additionally, a positioning pole adapted to be releasably received at its one end by said mounting bracket's other leg to aid in mounting said device attachment means to said hoop rim or bracket from a remote location, said pole being of a predetermined length to be operable by said user.

11. The device according to claim 10 wherein said positioning pole includes at its one end a spring actuated fitting.

12. The device according to claim 10 wherein said positioning pole includes at its other end a rope clamp and a measuring device to measure the height of a ball from a playing surface.

13. The device according to claim 10 wherein said hoop rim mounting bracket, said rope support arm and said positioning pole are made of aluminum.

14. The device according to claim 1 wherein said rope is an elastic bungie cord.

15. The device according to claim 1 wherein said means to attach said rope end to a ball includes a webb belt adapted to surround said ball, said belt fastened to said rope by a "D" ring.

* * * * *